United States Patent [19]

Torita

[11] 4,222,250

[45] Sep. 16, 1980

[54] AUTOMATIC WASHING MACHINE

[75] Inventor: Fumio Torita, Nagoya, Japan

[73] Assignee: Tokyo Shibaura Denki Kabushiki Kaisha, Kawasaki, Japan

[21] Appl. No.: 50,746

[22] Filed: Jun. 21, 1979

[30] Foreign Application Priority Data

Jun. 26, 1978 [JP] Japan ..... 53-77928

[51] Int. Cl.[3] ..... D06F 33/02

[52] U.S. Cl. ..... 68/12 R; 134/113

[58] Field of Search ..... 68/12 R; 134/57 D, 113

[56] References Cited

U.S. PATENT DOCUMENTS

| | | | |
|---|---|---|---|
| 2,430,668 | 11/1947 | Chamberlin | 68/12 R |
| 3,114,253 | 12/1963 | Morey et al. | 68/12 R |
| 3,807,418 | 4/1974 | Jenkins | 134/57 D |
| 3,888,269 | 6/1975 | Bashark | 134/57 D |

*Primary Examiner*—Philip R. Coe

*Attorney, Agent, or Firm*—Cushman, Darby & Cushman

[57] ABSTRACT

Provided is an automatic washing machine in which the washing, water-draining/dehydrating and rinsing steps are automatically carried out by an electronic control circuit including an electronic timer, arithmetic-operation processor and memory. The machine further includes a transparency detector for detecting at the initial stage of the washing step the transparency of water used in the washing step and supplying an output signal to the electronic timer so as to set the operating time for the washing and rinsing steps.

7 Claims, 9 Drawing Figures

AUTOMATIC WASHING MACHINE

This invention relates to an automatic washing machine.

Conventionally, there is provided a washing machine which permits a manual setting of the execution time period for washing or rinsing step in accordance with the degree of stain of the washing involved. This time is experimentally set by the user based on the visual judgement for the degree of stain of the washing. It is difficult, therefore, to exactly set the operating time for the washing or rinsing step in accordance with the degree of stain. The machine, therefore, has the drawback that it fails to suitably perform the washing or rinsing operation.

The object of the invention is to provide a washing machine which permits a setting of the execution time for washing or rinsing step to a length of time corresponding to the degree of stain of the washing involved.

According to a preferred embodiment of the invention, there is provided an automatic washing machine which comprises a rotatable tub structure for receiving washing therein, agitating means provided within the tub structure, driving means for selectively driving the agitating means and tub structure, control means including a timer circuit for setting the operating time for washing and rinsing steps and an information processor circuit for energizing the driving means in response to the time information from the timer circuit to selectively drive the tub structure and agitating means thereby to cause the washing and rinsing steps to be executed, and degree-of-transparency detecting means for detecting the transparency of water used at the initial stage of the washing step to supply to said control means an output signal corresponding to the transparency information from the degree-of-transparency detecting means thereby to set the operating time for at least one of the washing and rinsing steps.

This invention can be more fully understood from the following detailed description when taken in conjunction with the accompanying drawings, in which.

Figure 2:
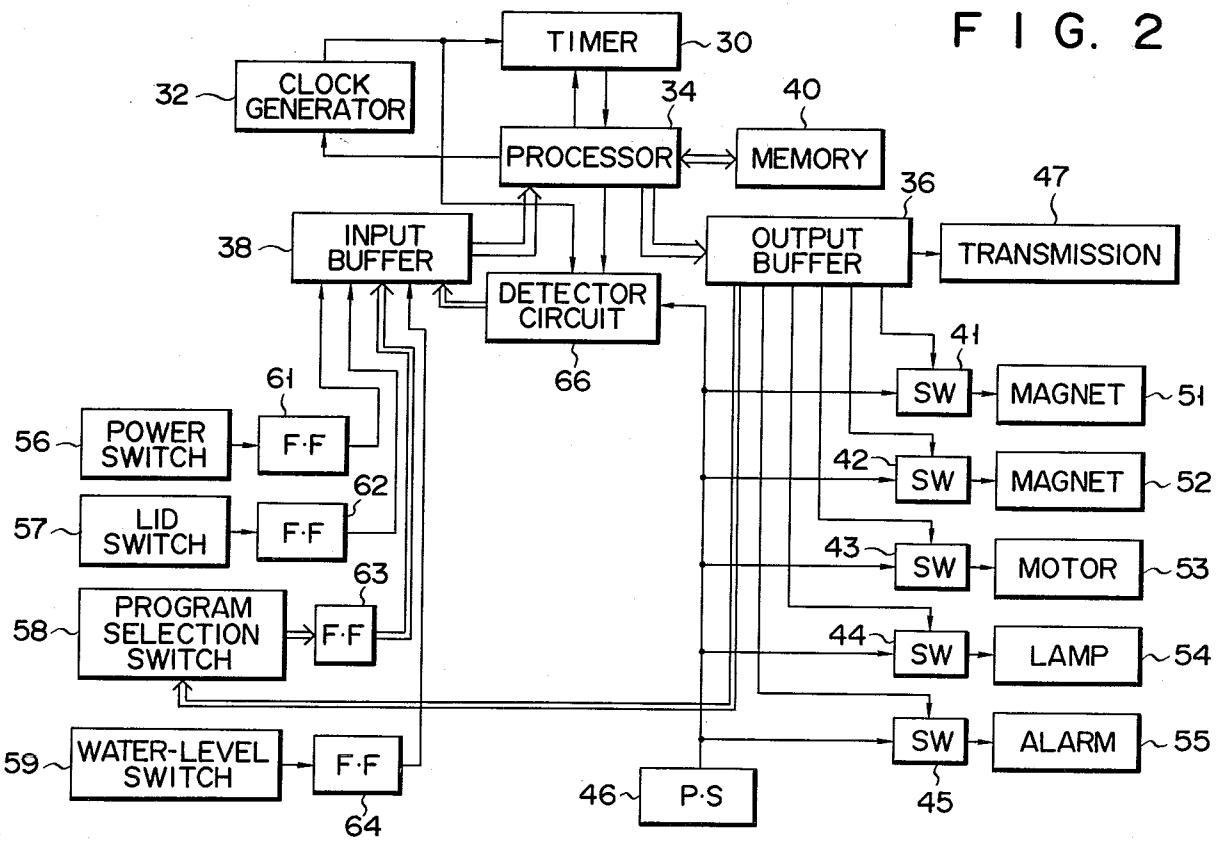
FIG. 2 is a block diagram of an electronic circuit incorporated in the automatic washing machine illustrated in FIG. 1.
Figure 4:
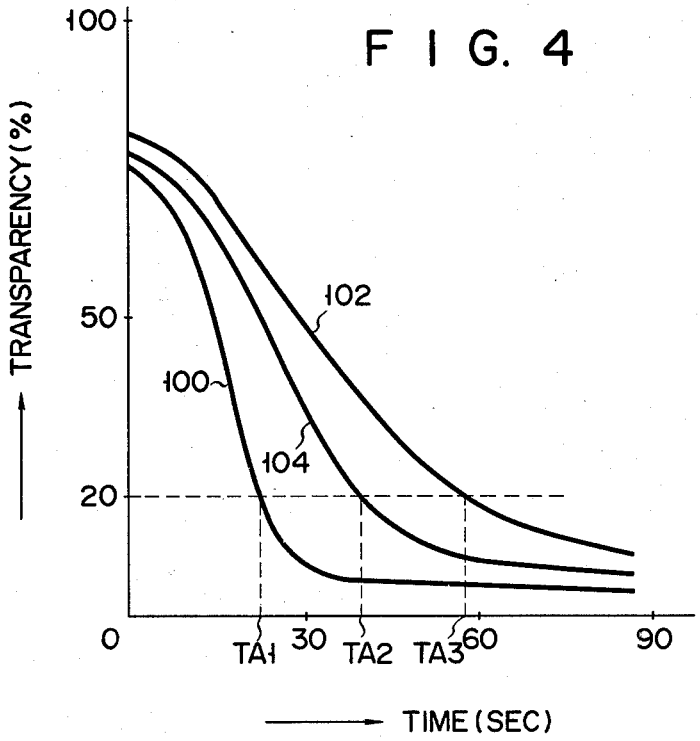
Figure 5:
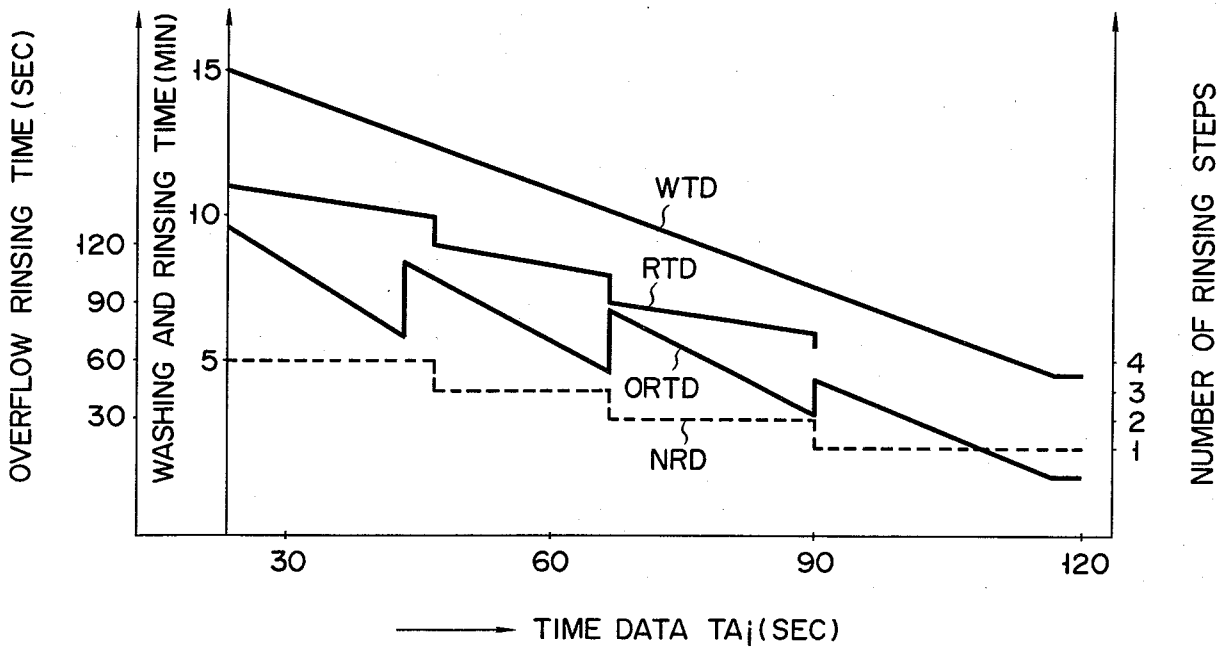

FIG. 4 graphically shows the relationship between the washing time and the transparency of the washing water;

FIG. 5 shows a washing data stored in a memory used in the electronic circuit illustrated in FIG. 2; and FIGS. 6 to 9 show washing sequences stored in the memory.

Figure 1:
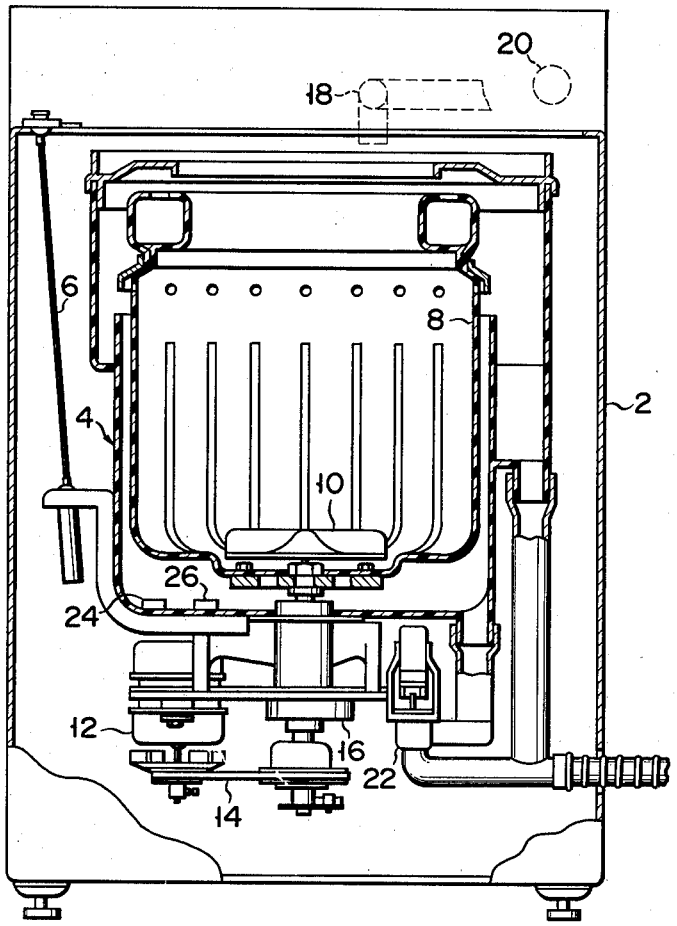
FIG. 1 is a view partly in section of an automatic washing machine according to an embodiment of the invention.

FIG. 1 shows a view partly in section of an automatic washing machine according to an embodiment of the invention. The machine shown in FIG. 1 includes an outer case 2, a water receiving tub 4 vertically movably supported by a support member 6 within the outer case 2, a washing and dehydrating tub 8 rotatably installed within the water receiving tub 4 and an agitator 10 provided in the tub 8. Within the outer case 2 is further disposed a power driven motor 12 for selectively driving the tub 8 and the agitator 10 through a belt type power transmission mechanism 14 and a power transmission control mechanism 16. Above the tubs 4 and 8 are disposed a water supply valve 8 for controlling the supply of water and a water level switch 20 for detecting the level of water in the tub 8. Below the tub 4 is disposed a water drainage valve 22 for controlling the drainage of the water used.

Further, within the tub 4 is disposed a degree-of-transparency detector to detect the transparency of water in the tub 4 which is comprised of a light emission element 24 such as a light emission diode and a light reception element 26 such as a phototransistor which is disposed opposite to the light emission diode 24.

FIG. 2 shows an electronic circuit section which is used in the automatic washing machine shown in FIG. 1. An electronic timer 30 counts the operating time for washing, dehydrating and rinsing steps in response to the timing signal from a clock pulse generator 32.

The time information from the electronic timer 30, parallel output level information from the input buffer circuit 38, and information corresponding to program information from a memory 40 are supplied in parallel from an information processor 34 to an output buffer circuit 36. The output terminals of the output buffer circuit 36 are respectively coupled to control terminals of switches 41 to 45 for controlling the coupling state between a power supply 46 and each of electromagnets 51, 52, motor 53, display lamp 54 and an alarm 55. Further output terminals of the output buffer circuit 36 are coupled, respectively, to a power transmission circuit 47 corresponding to the power transmission mechanism 14 and transmission control mechanism 16 of FIG. 1 and a decoder 48.

Further, a power switch 56, lid switch 57, program selection switch 58 and water level switch 60 are coupled to input terminals of the input buffer circuit 38 through flip-flops 61 to 64, respectively.

Further, a detector circuit 66 is coupled to another input terminal of the input buffer circuit 38. The detector circuit 66 includes a degree-of-transparency detector formed of the light emission element 24 and light reception element 26 shown in FIG. 1, which detector will be described later. The power switch 56, each time it is opened or closed, generates a pulse to change over the output level of the flip-flop 61. The lid switch 57, each time the lid of the washing machine shown in FIG. 1 is opened or closed, generates an ouput signal to change the output level of the flip-flop 62. The program selection switch 58 is so set as to suitably select the program stored in the memory 40. The water level switch 60, each time it is opened or closed in accordance with the water level in the water reception tub 4, generates an output signal to change over the output level of the flip-flop 64. Namely, in this embodiment, the flip-flops 61 to 64 is used to generate binary signals in accordance with the switching position of the switches 56 to 59, respectively.

Figure 3:
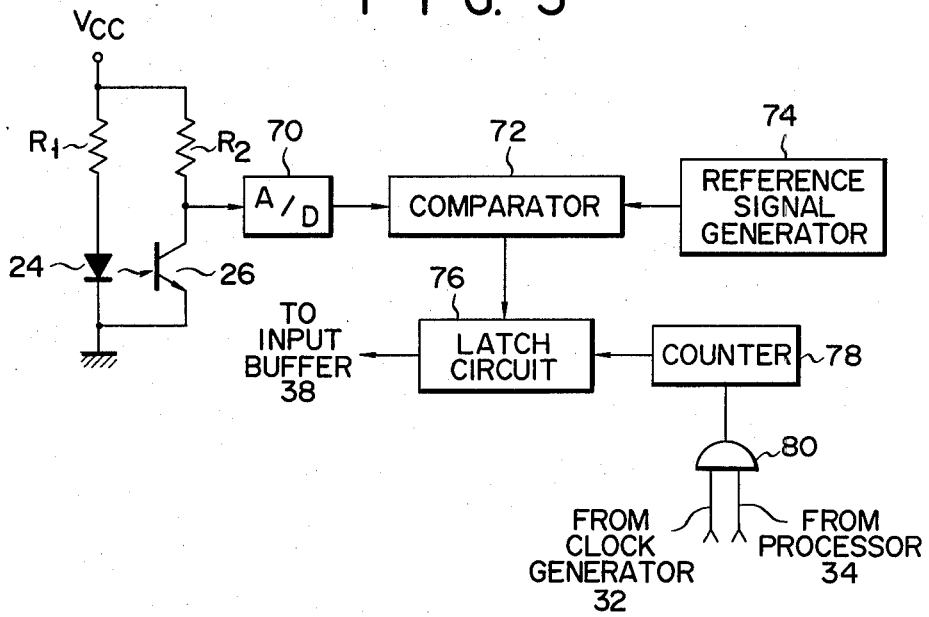
FIG. 3 is a circuit diagram of a detector circuit used in the electronic circuit illustrated in FIG. 2.

The detector circuit 66, as shown in FIG. 3, includes a series circuit of a resistor R1 and light emission diode 24 coupled between a power supply terminal $V_{CC}$ and a ground terminal, and a phototransistor 26 whose collector is coupled to a power supply terminal $V_{CC}$ through a resistor R2, whose emitter is grounded and whose base is arranged to receive the light from the light emission diode 24. from the collector of the phototransistor 26 is generated an output signal having an amplitude corresponding to the transparency of water in the tub 4, which output signal is supplied to an A/D converter 70 in which it is converted into a digital signal. The output signal from the A/D converter 70 is applied to one input terminal of a comparator 72 which receives at the other input terminal an output signal from a reference signal generator 74. When both input signals have coincided with each other, the comparator 72 applies a load signal to a latch circuit 76 from the comparator 72 to cause the output signal from a counter 78 to be stored in the latch circuit 76. The counter 78, as later described, is coupled to the output terminal of an AND gate 80 which receives at its input terminals a control signal from the processor 34 and a timing pulse from the clock generator 32, respectively.

The operation of the electronic circuit shown in FIG. 2 will now be described with reference to FIGS. 4 to 7.

When the power supply source 56 is turned on to commence the washing sequence, the flip-flop 61 is set to supply, for example, a signal of "1" level to the input buffer circuit 38 to change the corresponding output state thereof. When having detected such change in the output state of the input buffer circuit 38, the processor 34 causes a change in the output state of the output buffer circuit 36 to close the switch 41 to energize the electro-magnet 51. A water supply valve 18 is thereby opened to cause water to be poured into the tubs 4 and 8, whereby the washing operation is commenced. When having detected that the level of water in the tub 4 has reached a specified valve, the water level switch 59 produces an output signal to set the flip-flop 64 to cause change in the output state of the input buffer circuit 38. Having detected such change in the output level of the input buffer circuit 38, the processor 34 applies an energizing signal to the clock generator 32 and detector circuit 66, and also opens the switch 41, closes the switch 43 and supplies a control signal to the power transmission circuit 47, respectively through the output buffer 36. This causes a timing pulse to be generated from the AND gate 80 (FIG. 3) of the detector circuit, whereby the agitating vane 10 is driven to rotate by the motor 12 through the power transmission mechanism 14 and the transmission control mechanism 16 (FIG. 1).

When in this way the agitating vane 10 is driven to commence the washing step, the transparency of water in the tub 8 indicates such a change as shown in FIG. 4. In FIG. 4, the ordinate represents the percentage of the transparency of washing water with respect to clean water while the abscissa represents the time passage after the agitating vane 10 has started to rotate. The curves 100 and 102 indicate the cases of low and high stain of the washing involved and the curve 104 indicates changes with time in the transparency of water in the tub 4 in the case of intermediate stain of the washing. In this embodiment, the stain data of the washing is represented in terms of the time period, for example, TA1, TA2 or TA3 each of which is counted from the commencement of the washing step to a time at which the transparency of the washing water decreases to 20% (noted here that clean water is assumed to have a transparency of 100%).

As shown in FIG. 3, in washing step, a timing pulse is generated from the AND gate 80 and the counter 78 counts this timing pulse. On the other hand, the analog data as to the transparency of water in the tub 4 which has been detected by the light emission diode 24 and the phototransistor 26 is converted by the A/D converter 70 into digital data. The digital data is supplied to the comparator 72 and then compared with the input digital data from the reference signal generator 74 which represents the transparency of, for example, 20%. When both input data have coincided with each other, the comparator 72 supplies a load signal to the latch circuit, thereby to latch the contents of the counter 78 as they stand into the latch circuit 76. In this way, the information TAi as to the time period required from the commencement of rotation of the tub 8 to a time at which the transparency of washing water decreases to 20% is supplied to the input buffer circuit 38 from the latch circuit 76.

Figure 8:
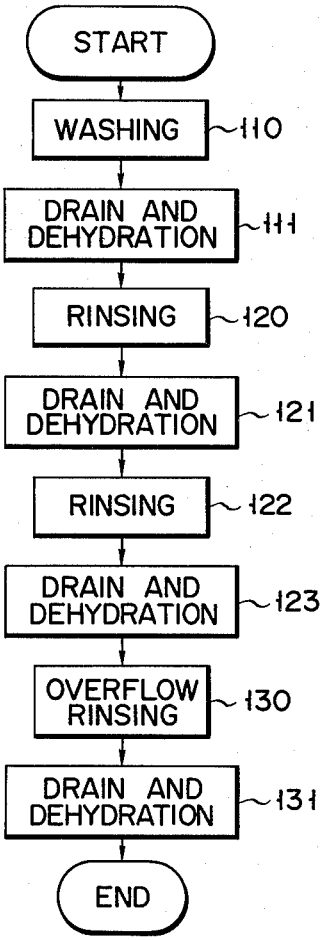
Figure 9:
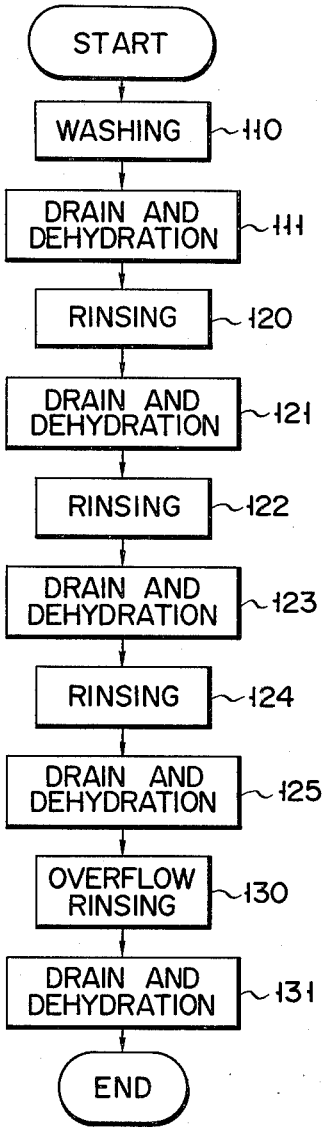

The processor 34, by using as an address signal the time information TAi stored in the input buffer circuit 38, reads the frequency-of-rinse-step data NRD from the memory 40 storing the washing information shown in FIG. 5 and writes this data into the output buffer circuit 36. The program selection switch 58 set to a switching position corresponding to the frequency-of-rinse-step data NRD written into the output buffer circuit 36 so operates as to set the state of the flip-flop circuit 63 which may be formed of a plurality of flip-flops to an output state corresponding to that switching position, thereby to cause the circuit 63 to supply to the input buffer circuit 38 a binary data corresponding to the frequency-of-rinse-step data NRD stored in the ouput buffer circuit 36. The processor 34, in this way, so operates as to select one of the washing sequences shown in FIGS. 6 to 9 on the basis of the binary data stored in the input buffer circuit 38. Further, the processor 34, by using as an address signal the time information TAi written from the detector circuit 66 into the input buffer circuit 38, sets the electronic timer 30 on the basis of the washing time data WTD, the rinsing time data RTD and the "overflow" rinsing time data ORTD read from the memory 40. The processor 34 thus sets the time for the washing and rinsing steps. For example, when it has been detected by the detector circuit 66 that the time data TAi is 60 sec., the number of the rinsing steps is set to 3. Whereby the washing sequence shown in FIG. 8 is selected which includes two normal rinsing steps and one overflow rinsing step. In this case, the washing time is set to approximately 11 minutes, the timer for the normal rinsing step is set to approximately 8.5 minutes, and the time for the overflow rinsing step is set to approximately 5.5 minutes.

When the period set for the washing operation has elapsed, the processor 34 detects that the washing step 110 has been completed, thereby to cause a change in the output level of the output buffer circuit 36 to close the switch 42 and open the switch 43. The motor 53 is thereby deenergized and stopped and so the agitator 10 ceases to rotate. Simultaneously, the electro-magnet 52 is energized to open the water drainage valve 22 so that the water drains from the tubs 4 and 8. When having detected that drainage is smoothly carried out through the water drainage valve, the processor 34 causes a change in the output level of the output buffer circuit 36 to energize the switch 43 and power transmission circuit 47 to rotate the tub 8, thus to carry out the water-draining/dehydrating step 111 for releasing the water from the tub 8 by the centrifugal force. When the time set by the timer 30 for the water-draining/dehydrating step has elapsed, namely when the washing operation has been completed, the processor 34 causes a change in the output state of the output buffer circuit 36 to open the switch 43. Simultaneously, the switch 41 is closed to again energize the electro-magnet 51 to supply water into the tubs 4 and 8 to commence the rinsing operation. Thereafter, a similar operation to that performed for the washing step 110 is performed for the rinsing step 120.

Figure 6:
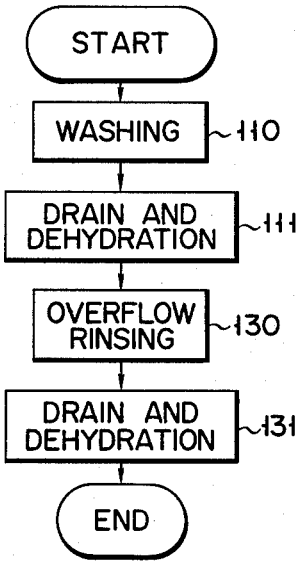
Figure 7:
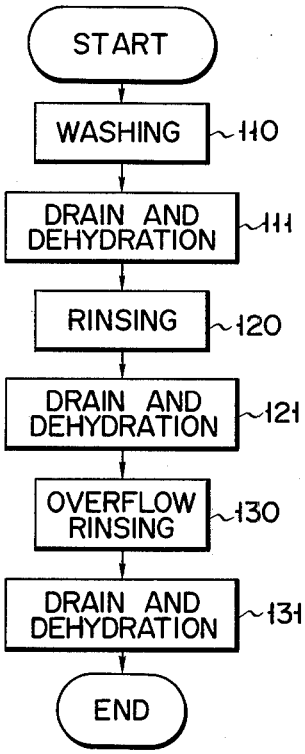

However, where the washing sequence shown in FIG. 6 has been selected, an overflow rinsing step 130 is carried out by causing the agitator 10 to rotate with the electro-magnet 51 kept energized, that is, with water supplied into the tub.

The operation time for the rinsing step 120 on for the overflow rinsing step 130 is set on the basis of the time data TAi from the detector circuit 66. After the elapse of the operation time for the rinsing step 120, a water-draining/dehydrating step 121 is executed in the same manner as in the operation step 111. Thereafter, in the case of the washing sequence shown in FIG. 7, the overflow rinsing step 130 is executed and in the case of the washing sequence shown in FIG. 8 the overflow rinsing step 130 is executed after execution of a rinsing step 122 and water-draining/dehydrating step 123 similar to the rinsing step 120 and water-draining/dehydrating step 121. Further, in the washing sequence shown in FIG. 9 the overflow rinsing step 130 is executed after a further rinsing step 124 and water-draining/dehydrating step 125 is executed subsequently to the rinsing step 124 and water-draining/dehydrating step 125. After the elapse of the operating time set for the overflow rinsing step 130, a final water-draining/dehydrating step 131 is executed. After completion of this step 131, namely after completion of the rinsing operation, the processor 34 causes a change in the output state of the output buffer circuit 36 to close the switches 44 and 45 to energize the lamp 54 and alarm 55, thus informing that the current washing sequence has been completed.

The invention has above been explained by describing one embodiment, but is not limited thereto. For example, in the above embodiment the program selection switch 58 is set to a position corresponding to the output signal from the detector circuit 66. However, it is also possible to manually set this switch 58 and it becomes unnecessary to store the frequency-of-rinse-step data NRD shown in FIG. 5 into the memory 40.

Further, the detector circuit 66, in the abovementioned embodiment, is so constructed as to detect the period from the commencement of the washing step 110 until a time when the transparency of the washing water becomes 20%. The detector circuit 66, however, may be so constructed as to detect the transparency of the washing water after the elapse of a specified period, for example, 60 sec. from the commencement of the washing step 110. In this case, however, it is necessary to store in the memory 40 the data indicating the relation between the transparency data from the detector circuit and each of the washing period of time, frequency-of-rinse-step, rinsing period of time and "overflow" rinsing period of time.

Further, the washing data shown in FIG. 5 is shown only as an example and various modifications thereof are possible.

What is claimed is:

1. Automatic washing machine comprising:

a rotatable tub structure for receiving washing therein;

agitating means provided within said tub structure;

driving means for selectively driving said tub structure and agitating means;

control means including a timer circuit for setting the operating time for washing and rinsing steps and an information processor circuit for energizing said driving means in response to the time information from said timer circuit to selectively drive said tub structure and agitating means thereby to execute the washing and rinsing steps; and a transparency detector means for detecting the transparency of water used in the washing step at the initial stage thereof and for supplying an output signal corresponding to the transparency information thus detected to said information processor circuit, whereby said information processor circuit sets said timer circuit to set the operating time for at least one of said washing and rinsing steps.

2. The automatic washing machine according to claim 1, wherein said transparency detector means measures a period of time required from the beginning of rotation of said agitating means under the washing step until a time when the transparency of water used under the washing step reaches a specified value, and generates an output signal corresponding to said period of time so required.

3. The automatic washing machine according to claim 1 or 2, wherein said control circuit has memory means stored with washing data indicating the relationship between the operating time for at least one of said washing and rinsing steps and the output signal of said transparency detector means; and said information processor circuit reads washing data corresponding to the output signal of said transparency detector means from said memory means and sets said timer circuit on the basis of said washing data thus read out from said memory means.

4. The automatic washing machine according to claim 1 or 2, wherein said control circuit includes memory means stored with a plurality of washing sequence data and switching means set by said information processor circuit to a position corresponding to the output signal from said transparency detector means; and said information processor circuit reads out the washing sequence data corresponding to the output signal from said switching means and controls said driving means on the basis of the washing sequence data thus read out and the time data from said timer circuit.

5. The automatic washing machine according to claim 4, wherein said washing sequence data comprises data for a first washing sequence including the washing step and one overflow rinsing substep, and data for a second washing sequence including the washing step, at least one rinsing substep and one overflow rinsing substep.

6. The automatic washing machine according to claim 1 or 2, wherein said rinsing step includes at least one rinsing substep and a draining operation substep which is performed in subsequence to the rinsing substep.

7. The automatic washing machine according to claim 1 or 2, wherein said rinsing step includes an overflow rinsing substep and is completed by performing a subsequent draining dehydrating substep.

* * * * *